United States Patent [19]

Nodo

[11] Patent Number: 4,799,324

[45] Date of Patent: Jan. 24, 1989

[54] FIREARM RECOIL ATTENUATOR AND METHOD

[76] Inventor: Nicholas L. Nodo, Rte. 1, Box 39, Rice, Minn. 56367

[21] Appl. No.: 141,830

[22] Filed: Jan. 11, 1988

[51] Int. Cl.[4] ..... F41C 29/00

[52] U.S. Cl. ..... 42/94

[58] Field of Search ..... 42/94; 89/37.04

[56] References Cited

U.S. PATENT DOCUMENTS

| | | | |
|---|---|---|---|
| 1,367,353 | 2/1921 | Craig | 73/167 |
| 1,457,407 | 6/1923 | Stokes | 89/37.04 |
| 2,378,545 | 6/1945 | Fraser et al. | 89/1 |
| 2,877,689 | 3/1959 | Pribis | 89/37.04 |
| 3,358,504 | 12/1967 | Freebairn | 73/167 |
| 3,609,902 | 10/1971 | Casull | 42/94 |
| 4,012,860 | 3/1977 | Auger | 42/94 |
| 4,333,385 | 6/1982 | Culver | 89/37.04 |
| 4,621,563 | 11/1986 | Poiencot | 89/37.04 |

FOREIGN PATENT DOCUMENTS

| | | | |
|---|---|---|---|
| 46181 | 2/1982 | European Pat. Off. | 89/37.04 |
| 499816 | 11/1919 | France | 89/37.04 |
| 1302 | 1/1914 | United Kingdom | 42/94 |

*Primary Examiner*—Charles T. Jordan

*Attorney, Agent, or Firm*—Leo Gregory

[57] ABSTRACT

A horizontal platform like support member less in length than the length of a rifle, a socket member made up of a unitary piece of a suitable flexible material having a forward strap like extension secured to the support member and a post elevating the barrel of the rifle make up an apparatus whereby the recoil forces of the rifle are attenuated and transferred to the support member.

2 Claims, 2 Drawing Sheets

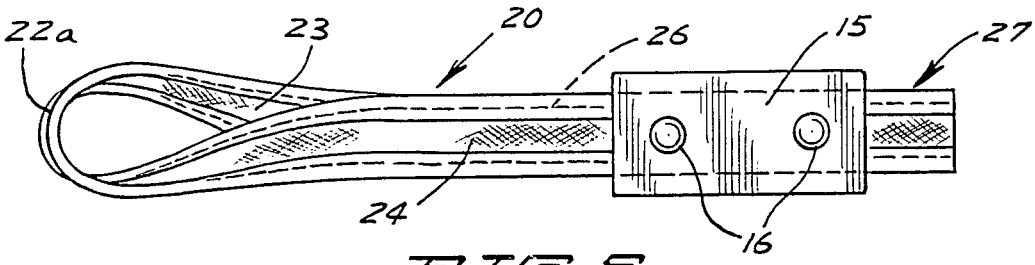
FIG. 5
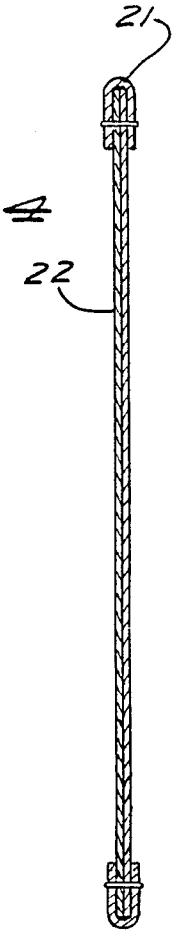
FIG. 4
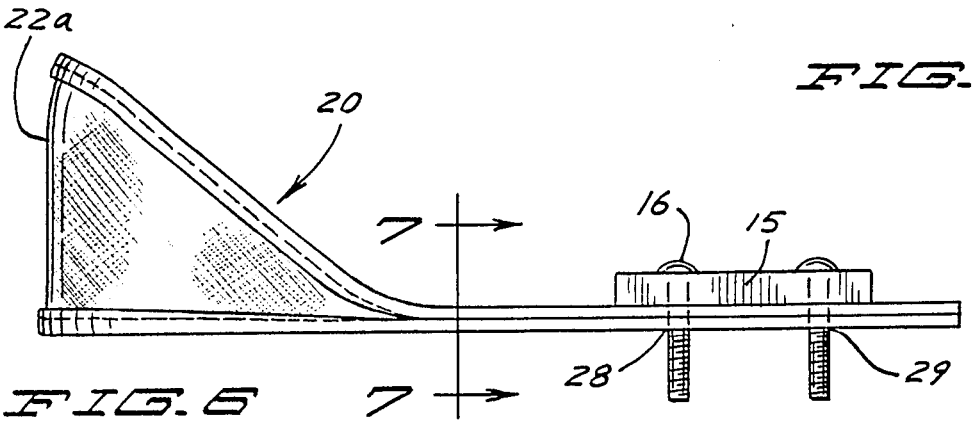
FIG. 6
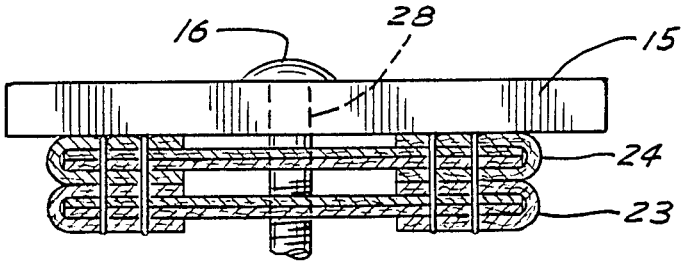
FIG. 7
FIG. 8
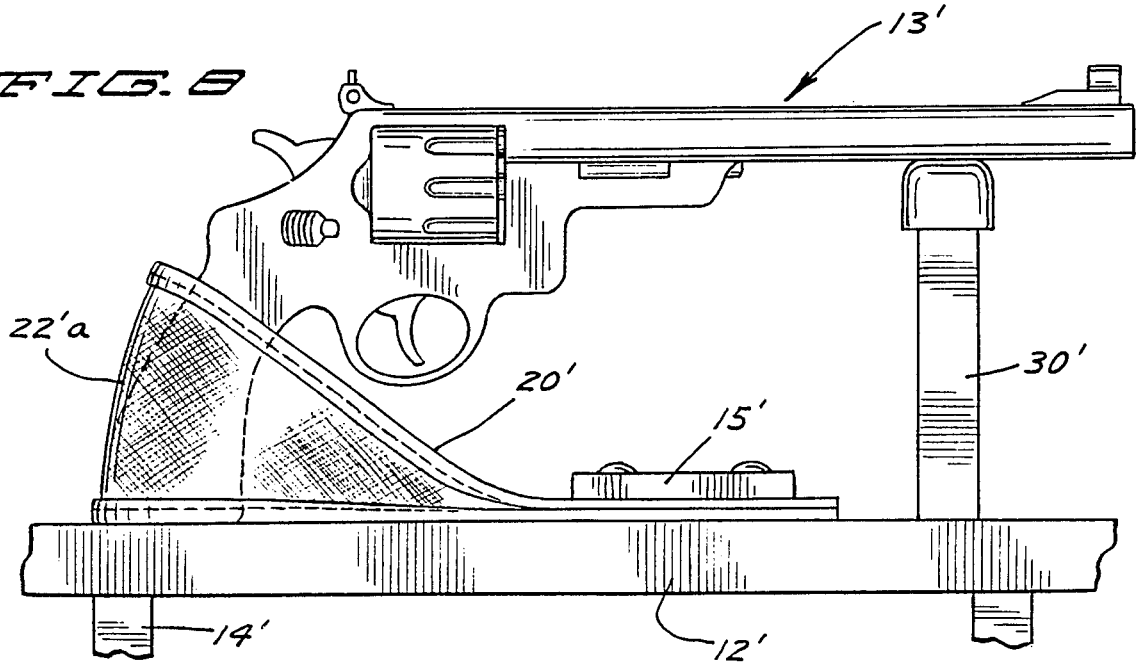

FIREARM RECOIL ATTENUATOR AND METHOD

BACKGROUND OF THE INVENTION

1. Field of Invention

This invention relates to firearm recoil attenuating devices.

2. Brief Description of the Prior Art

There is a substantial interest in recoil force transferring or insulating devices to relieve the shoulder of the operator from the shock or impact of a recoil force. In range firing and in sighting in a rifle, there is continuous firing for periods of time where in steadiness and accuracy are of utmost importance and where in continuous exposure to the impact of recoil force has a substantial adverse effect on the shoulder of an operator and on his steadiness in operating the firearm.

The prior art discloses complex devices for negating the effect of recoil force and such devices for the most part are not manually transportable by an operator.

As an indication of the complex devices of the prior art reference is had to U.S. Patent Nos. 4,012,860 to Auger, 1,457,407 to Stokes and 3,358,504 to Freebairn wherein mobile transport is required to move the devices.

It is desirable to have an easily manually transportable device of a simple structure for negating or attenuating the recoil force of a firearm.

SUMMARY OF THE INVENTION

Disclosed herein is a very simply made and readily carried device to relieve the operator of a firearm from the force of recoil in firing a gun.

It is an object of this invention therefore to provide a firearm rest comprising a simple support member having a simple structure to retain the butt of a firearm.

It is another object of the invention herein to provide a simple firearm or gun rest readily placed into or lifted out of position and requiring no mechanical moving parts for its use.

More specifically it is an object of this invention to provide a simple plate like support member having a socket secured thereon to retain the butt of a firearm and having a vertical rest to support a gun barrel, the device being ground supported and readily manually carried and stored by the operator.

These and other objects and advantages of the invention will be set forth in the following description made in connection with the accompanying drawing in which like reference characters refer to similar parts throughout the several views.

BRIEF DESCRIPTION OF THE DRAWINGS

FIG. 4 is a view in vertical section taken on line 4—4 of FIG. 3 as indicated;

FIG. 5 is a top plan view of a detail;

FIG. 6 is a view similar to that of FIG. 5 in side elevation;

FIG. 7 is a view in vertical section taken on line 7—7 of FIG. 6 as indicated;

FIG. 8 is a modification in side elevation with portions broken away. cl DESCRIPTION OF A PREFERRED EMBODIMENT Referring to the drawings, a support or rest member 10 is shown comprising a platform or plate member 12 which may readily be made of a suitable board member having a length somewhat less than the length of a rifle, such as the rifle 13 indicated and having suitable underlying support members or feet 14.

Figure 1:
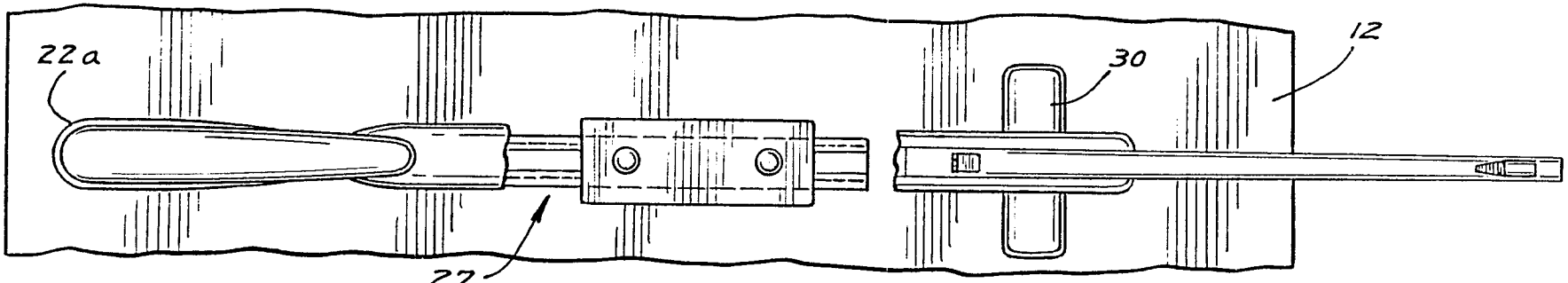
FIG. 1 is a top plan view.

Spaced inwardly from the end portion 12*a* of said member 12 is a relatively small plate like holding or securing member 15 overlying said platform member 12 and being secured thereto, as here shown, by a pair of nutted bolts 16.

Provided to contain and retain the butt 13*a* of said rifle 13 is a socket member 20. Said socket member may be variously formed within the concept herein and by way of illustration and not limitation, in the disclosed embodiment, it is shown formed of a unitary piece of suitable material as a blank 21 in FIG. 2. Said material is necessarily non-stretchable and of a tough weather resistant long wearing material. An example of a suitable material is a synthetic fabric made by the Dupont Corporation bearing the trademark CORDURA.

As shown in said blank form 21, said socket member has a triangular projection 22 to one side thereof and elongated somewhat narrow strap portions 23 and 24 extending at each end thereof. The edge of said blank is taped as at 25.

Figure 2:
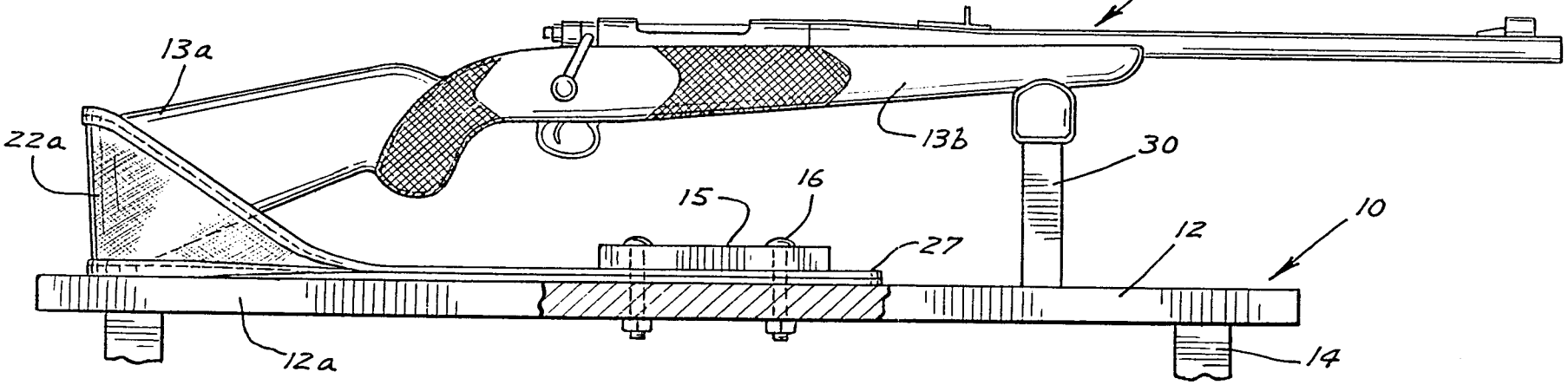
FIG. 2 is a side elevational view.
Figure 3:
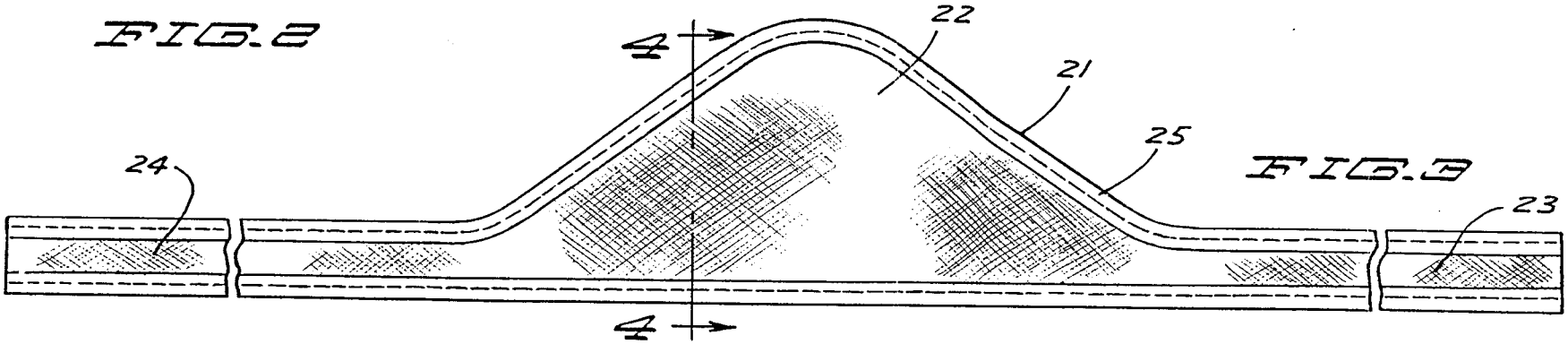
FIG. 3 is a top plan view of a blank with portions broken away.

As in FIG. 2, said socket blank 21 is disposed as if in a vertical plane. As viewed in FIG. 5, to be folded to form a socket, the leg 23 is twisted 90 degrees to the right to underlie the leg 24. The twisting motion of the leg 23 has caused the projected portion 22 to form a socket 22*a*. The legs 24 and 23 in superposed position form a strap 27 which is aperatured as at 28 and 29 and the same are stitched as at 26 to be unitary.

Said socket member 20 is positioned upon said support member 12 adjacent the end 12*a* thereof and the strap 27 is disposed between the holding member 15 and the support member 12 having the bolts 16 pass through the aperatures 28 and 29 and thus securing said socket member in operating position.

A vertical support or post 30 is provided upstanding from said support member 12 to underlie and support the stock 13*b* of said rifle 13.

MODIFICATION

A modification of the structure above described is shown in FIG. 8, wherein the rifle 13 above referred is shown to be in the-form of a handgun or pistol 13'.

The structure of the modification is identical to that above described with the exception of being reduced to size to be relative to the size of said handgun and like parts are indicated by like reference characters with a prime added.

OPERATION

The operation of the support structure herein described is fairly obvious from the description given. The socket 20 or in the case of the modification, the socket 20' substitutes for the operator's shoulder or hand, as the case may be, in holding the firearm. The operator is left free from the successive impacts of recoil force experienced by the body in holding the firearm. The recoil force is transferred to the platform. The operator is left in good condition to control accuracy in shooting such as in sighting in a rifle or being engaged in target shooting or shooting competitions.

The simplicity and portability of the devices described are among its salient features.

It will of course be understood that various changes may be made in the form, details, arrangement and proportions of the apparatus and in the steps and sequence of steps of the method without departing from the scope of the applicant's invention which, generally stated, consists in an apparatus and method capable of carrying out the objects above set forth, such as disclosed and defined in the appended claims.

I claim:

1. A firearm recoil attenuating device, comprising an elongated support platform member a socket member of flexible non-stretchable material having a vertical back wall and having forwardly extending strap members having superposed angled end portions, means securing said end portions to said support member, and an elevating means upstanding from said support member to elevate a firearm into sighting position.

2. The method of attenuating a firearm recoil force, consisting of the steps of providing a blank of suitable material having a laterally projecting portion and having longitudinally extending straps at each end thereof, twisting said straps to be at right angles to the plane of said projecting portion, superposing said straps to overlie one another causing said blank to become doubled up and form a socket, providing an elongated supporting platform member, disposing said socket and strap onto said platform member, securing said straps to said platform member, providing a vertical rest for a the stock portion of said firearm, and disposing the butt of said firearm into said socket and the stock portion thereof onto said rest.

* * * * *